US010209018B1

(12) United States Patent
Yaxley et al.

(10) Patent No.: US 10,209,018 B1
(45) Date of Patent: Feb. 19, 2019

(54) CARTRIDGE SPEED LOADER FOR USE WITH A REVOLVER CYLINDER BARREL

(71) Applicants: Chason Yaxley, Sterling Heights, MI (US); Kenneth Robert Yaxley, Sterling Heights, MI (US)

(72) Inventors: Chason Yaxley, Sterling Heights, MI (US); Kenneth Robert Yaxley, Sterling Heights, MI (US)

( * ) Notice: Subject to any disclaimer, the term of this patent is extended or adjusted under 35 U.S.C. 154(b) by 0 days.

(21) Appl. No.: 15/879,029

(22) Filed: Jan. 24, 2018

Related U.S. Application Data

(60) Provisional application No. 62/568,054, filed on Oct. 4, 2017.

(51) Int. Cl.
*F41A 9/85* (2006.01)

(52) U.S. Cl.
CPC ..... *F41A 9/85* (2013.01)

(58) Field of Classification Search
CPC ..... F41A 9/85
See application file for complete search history.

(56) References Cited

U.S. PATENT DOCUMENTS 891,374 A 6/1908 Ruszitszka
3,213,559 A * 10/1965 Matich ..... F41A 9/85 206/3
3,706,260 A 12/1972 Rausing
4,254,571 A * 3/1981 Peter ..... F41A 9/85 42/89
4,325,198 A 4/1982 Muck et al.
4,402,153 A * 9/1983 Peter ..... F41A 9/85 42/89
4,614,053 A 9/1986 Billman
4,862,622 A 9/1989 Goyanes
7,363,845 B2 * 4/2008 McClellan ..... F41A 9/85 42/89
9,835,396 B1 * 12/2017 Sherman ..... F41A 9/85

FOREIGN PATENT DOCUMENTS

GB 398690 A * 9/1933 ..... F41A 9/84

* cited by examiner

*Primary Examiner* — Joshua T Semick
(74) *Attorney, Agent, or Firm* — Dinsmore & Shohl LLP

(57) ABSTRACT

A speed loader clip for supporting a plurality of cartridges in a cylindrical array, prior to being loaded into a plurality of individual chambers configured within a rotated open cylinder barrel of a revolver style firearm. A band of a solid one piece plasticized material includes individual pairs of inward projecting and arcuate grasping portions adapted for supporting individual ones of the cartridges. End support tabs extend between each of the pairs of projecting portions for preventing cartridge slide-out during loading into the cylinder barrel. End clasp portions are integrated into each of opposite ends of the band to permit the clip to be carried in a closed position with the supported cartridges so that, upon inserting the projecting tips of the clip supported cartridge into the barrel cylinder of the revolver, a tab located in proximity to a selected one of the inter-engaged end clasp portions is manipulated to open the band and to permit the cartridges to fall into the individual cylinder chambers.

14 Claims, 11 Drawing Sheets

CARTRIDGE SPEED LOADER FOR USE WITH A REVOLVER CYLINDER BARREL

CROSS REFERENCE TO RELATED APPLICATIONS

The present application claims priority from U.S. Ser. No. 62/568,054 filed Oct. 4, 2017.

FIELD OF THE INVENTION

The present invention relates generally to a speed loader clip for supporting a plurality of cartridges in a cylindrical array, prior to these being loaded into a rotated open cylinder barrel of a revolver style firearm. More specifically, the present invention discloses a clip loader band of a solid one piece plasticized material including individual pairs of inward projecting and arcuate grasping portions, between which are configured support tabs for supporting individual cartridges. Engagement or clasp portions are configured on opposite ends of the solid band and, upon being grasped in position over the barrel, are opened to permit loading of the cartridges within the individual receiving cylinders configured within the barrel.

BACKGROUND OF THE RELEVANT ART

The prior art is documented with examples of speed loader devices for use with a cylindrical barrel such as a revolver style pistol or other firearm and for quickly loading a plurality of cartridges into the barrel when rotated to the open position.

McClellan, U.S. Pat. No. 7,363,845, teaches a concealable speed loader for firearms including a flexible, one-piece body having a flat open condition defined by a plurality of living hinges configured in crosswise, plural and spaced apart fashion and, when joined end to end, defining a closed annular condition with two ends and a given width. The body has grasping chambers for receiving cartridges with a length substantially greater than the given width, causing part of the length of the cartridges to protrude from the body in both the open and the closed conditions. A locking latch latches the two ends of the body in the closed condition for placement above a cylinder of a firearm with the cartridges protruding into chambers of the cylinder. The locking latch has a knob to be pulled for manually removing the body and releasing the cartridges in turn as the cylinder rotates and the cartridges drop fully into the chambers of the cylinder.

Other references drawn from the prior art include the loading device for revolvers of Matich, U.S. Pat. No. 3,213,559 which teaches an apparatus for loading cartridges into the cylinder of a revolver. The apparatus includes an elongated flexible belt having a plurality of longitudinally spaced transverse divider walls extending from one side of the belt, the intermediate portion of each wall being concave on opposite faces to format the end of each wall farthest from the belt for holding cartridges in an arrangement to fit into the revolver cylinder, the belt, walls, and abutting adjacent ribs combining to extend around substantially the entire circumference of each cartridge to secure each cartridge along a substantial portion of its length within its respective recess.

Yet additional references of note include the cartridge loader for revolvers of U.S. Pat. No. 4,325,198 to Muck et al., the snap link type cartridge speed loading device of Billman, U.S. Pat. No. 4,614,053, and the link type cartridge speed loading device of Goyanes U.S. Pat. No. 4,862,622.

SUMMARY OF THE PRESENT INVENTION

The present invention discloses a speed loader clip for supporting a plurality of cartridges in a cylindrical array, prior to being loaded into a plurality of individual chambers configured within a rotated open cylinder barrel of a revolver style firearm. A band of a solid one piece plasticized material includes individual pairs of inward projecting and arcuate grasping portions adapted for supporting individual cartridges.

End support tabs extend between each of the pairs of projecting portions for preventing cartridge slide-out during loading into the cylinder barrel. End clasp portions are integrated into each of opposite ends of the band to permit the clip to be carried in a closed position with the supported cartridges so that, upon inserting the projecting tips of the clip supported cartridge into the barrel cylinder of the revolver, a tab located in proximity to a selected one of the inter-engaged end clasp portions is manipulated to open the band and to permit the cartridges to fall into the individual cylinder chambers.

In this fashion, the tabs prevent cartridge slide-out during loading into the cylinder barrel. Opposing end clasp portions permit the clip to be carried in a closed position with the supported cartridges and, upon inserting into the barrel cylinder of the revolver, the tab is actuated/pulled for opening the same and permitting the cartridges/bullets to fall into the individual cylinder chambers.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 11:
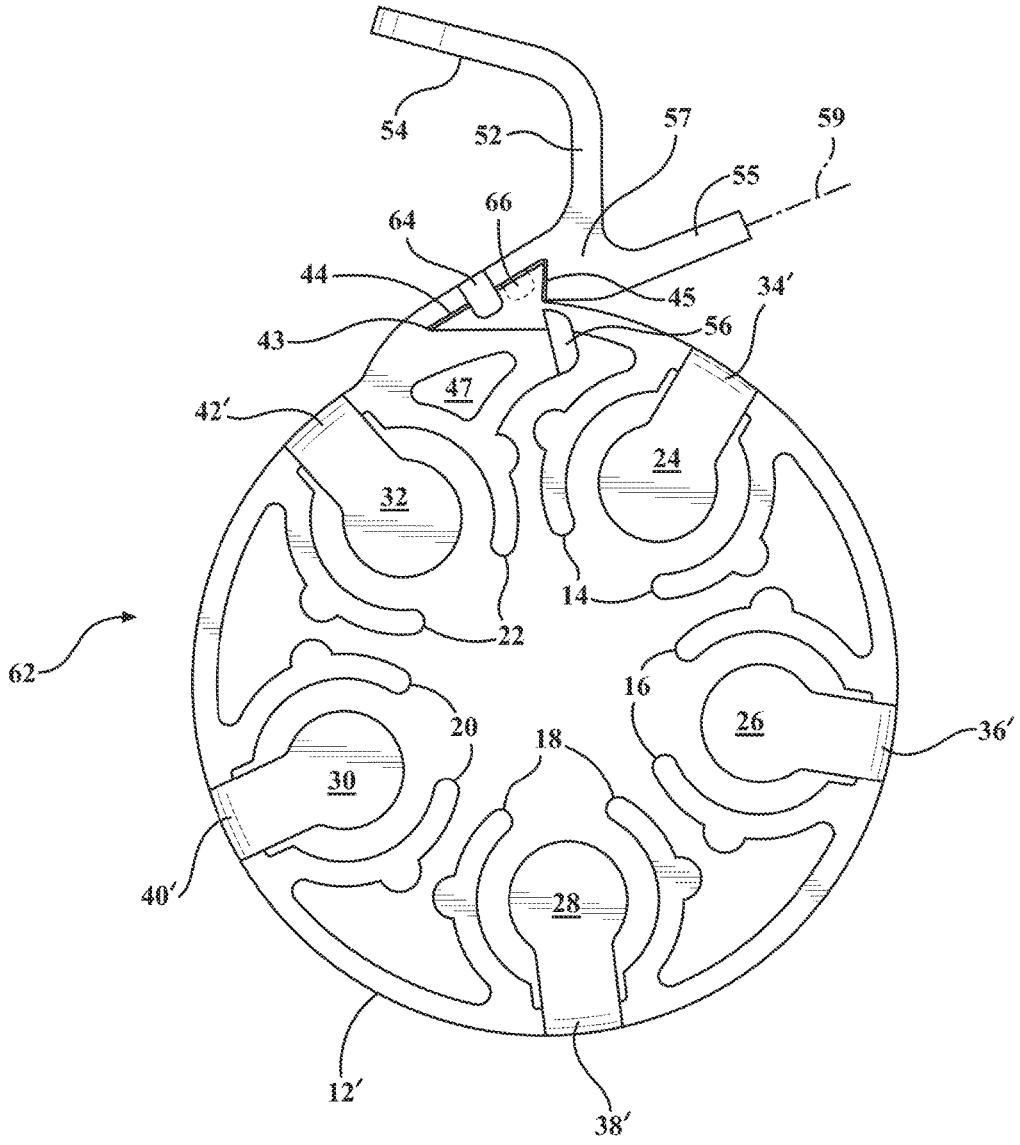
FIG. 11 is a bottom plan view similar to FIG. 7 depicting the clip in an engaged/closed position.
Figure 12:
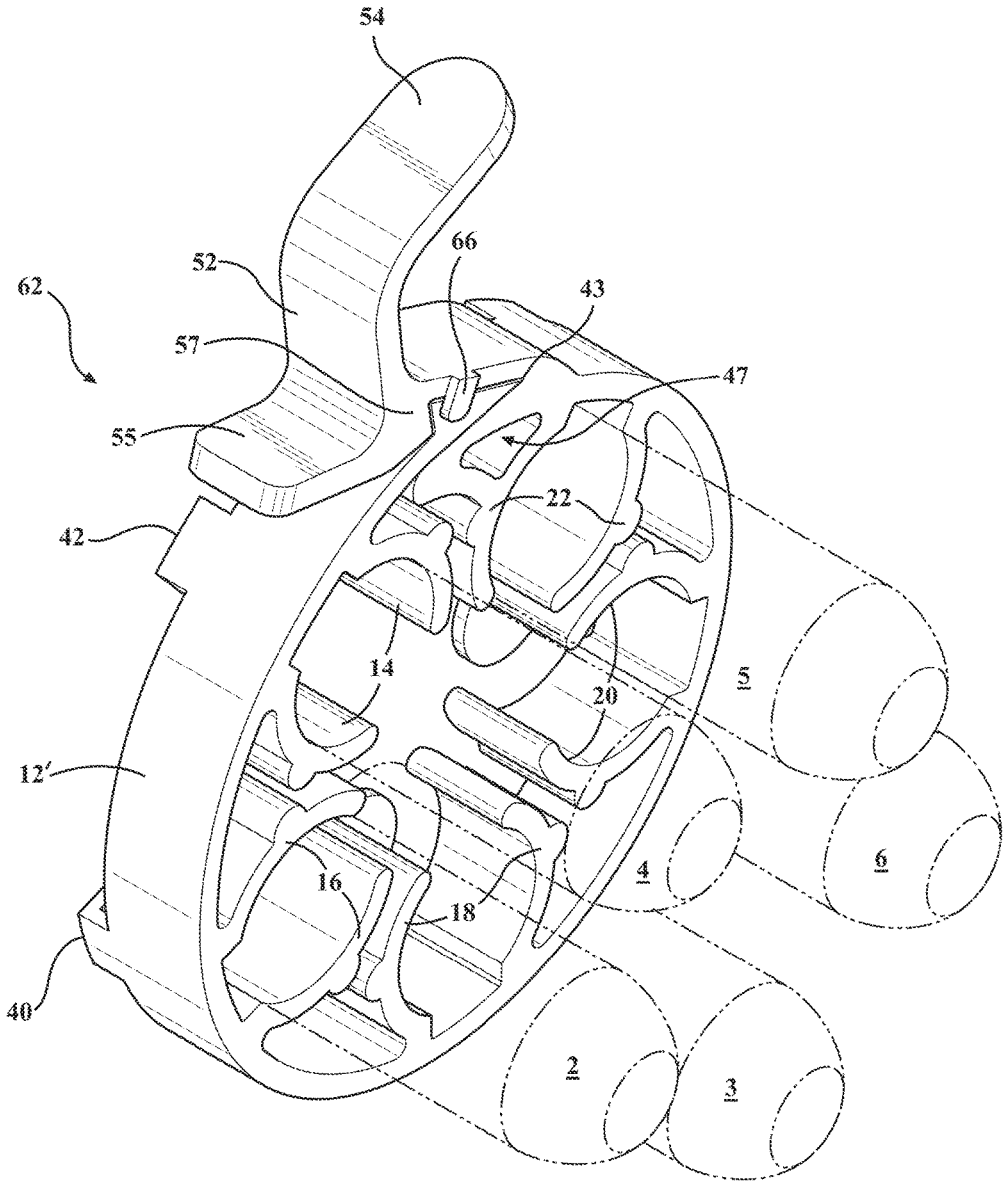
FIG. 12 presents an environmental perspective of the clip, such as depicted in FIG. 7, in a closed position and holding a plurality of individual cartridges in engaged and end tab supported (slide-out preventing) fashion according to the invention.

With reference to the attached illustrations, the present invention relates generally to a speed loader clip for supporting a plurality of cartridges in a cylindrical array, prior to these being loaded into a rotated open cylinder barrel of a revolver style firearm (see as shown in FIG. 12). More specifically, the present invention discloses a clip loader band of a solid one piece plasticized material, a first version of this depicted at 10 in FIGS. 1-6 and a second related version at 10' in FIGS. 7-12, and including individual pairs of inward projecting and arcuate grasping portions for supporting the cartridges, along with end support tabs for preventing cartridge slide-out during loading into the cylinder barrel. As will be additionally described, additional features of the invention include opposing end clasp portions permit the clip to be carried in a closed position with the supported cartridges and, upon inserting into the barrel cylinder of the revolver, a tab in proximity to the interengaged end clasp portions being pulled for opening the same and permitting the cartridges/bullets to fall into the individual cylinder chambers.

Figure 1:
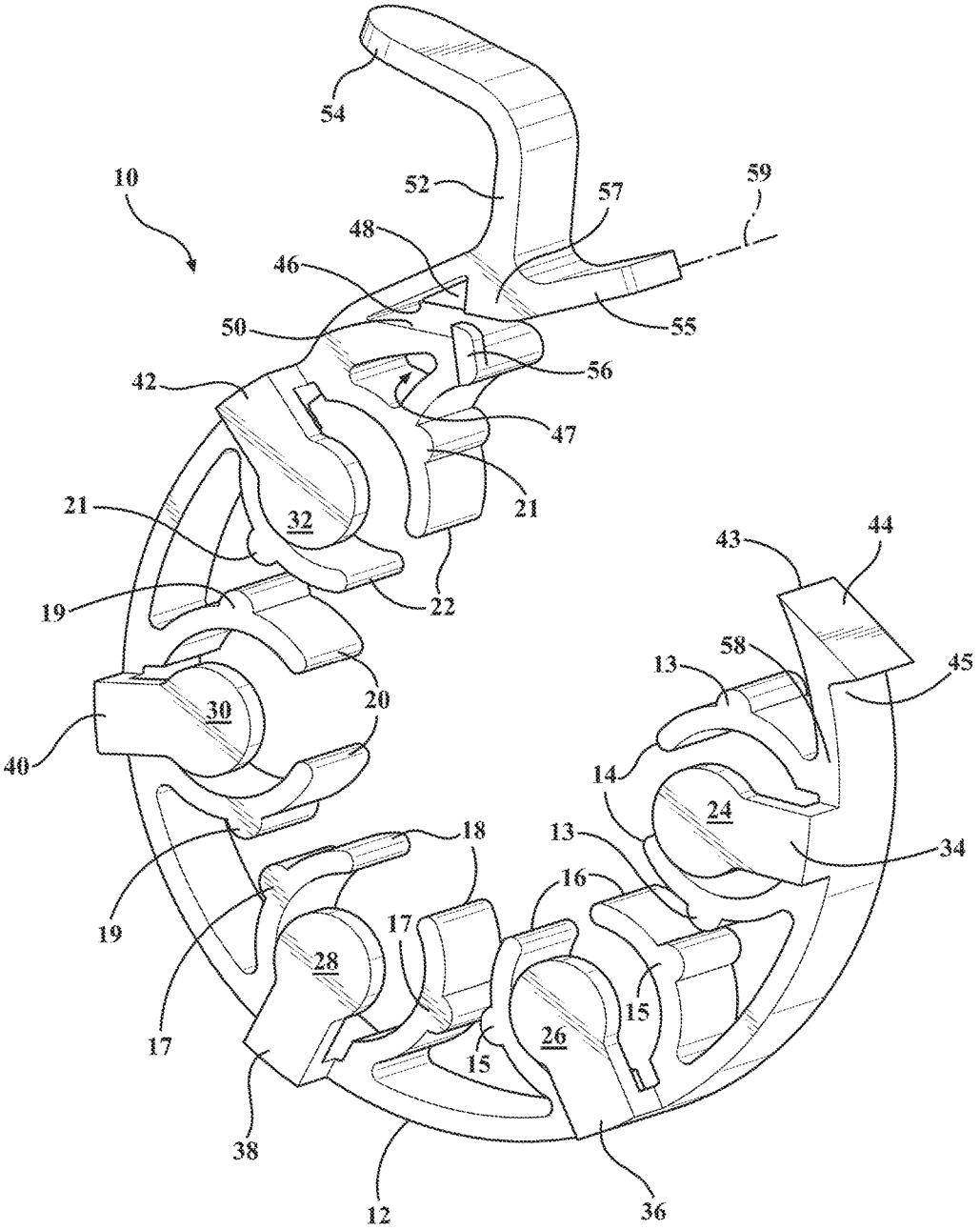
FIG. 1 is an elevational view of the cartridge retaining and loading clip according to a first variant in an unlatched/open position, shown from a rear supporting side and depicting the features of the individual pairs of inward projecting and arcuate grasping portions for supporting the cartridges, along with end support tabs for preventing cartridge slide-out during loading into the cylinder barrel.

Referring now to FIG. 1, an elevational view is shown at 10 of the cartridge retaining and loading clip in an unlatched/open position, this shown from a rear or underside supporting side. The clip is depicted as a solid outer band extending in a substantially arcuate and cylindrical shape at 12 and which can be constructed of any suitable plasticized or other flexible and shape retaining material exhibiting the necessary properties of flexibility and durability.

The outer band has a given material thickness and can further exhibit any desired dimensions, with a width dimension a fraction of an overall circumferential length dimension thereof and, as will be further described, is adapted to support a plurality of cartridges for subsequent loading into the open revolver cylinder (not shown). To this end, the width of band can vary between that shown at 10 in FIGS. 1-6 and 62 in FIGS. 7-12, and can be reconfigured to support any plurality of individual cartridges (such as shown 2, 3, 4, 5 and 6 in FIG. 12 corresponding to a five barrel arrangement) ranging upward to six or seven barrel arrangements.

Additionally depicted features associated with the clip include individual pairs of inward projecting and arcuate grasping portions, for a five cartridge clip being shown by pairs of arcuate grasping portions at 14, 16, 18, 20 and 22 extending integrally from inward circumferential surface locations of the solid band 12 for supporting the cartridges in a desired circumferential supported array prior to these being loaded into the revolver cylinder. As depicted, the pairs of grasping portions which, as shown in non-limiting representation, each have height corresponding to the width of the clip body a defined thickness in cross section and, in profile, exhibit a crescent shape such that the space dimensions between individual pairs is configured for grasping the individual cartridges therebetween. Without limitation, any type of protuberance or surface embossment can be configured upon an exterior arcuate location of each grasping portion (these depicted by pairs of semi-cylindrical shapes at 13, 15, 17, 19 and 21 respectively in FIG. 1 for the pairs of arcuate grasping portions 14, 16, 18, 20 and 22).

As further shown, the pairs of grasping portions extend the inner width of the band 12 and define a space or gap between their inner extended ends, such facilitating any necessary degree of flex in order to receive and support the cartridges (again at 2-6 in FIG. 12) in a reasonable gripping fashion. Additionally, and while the illustrated embodiment depicts five circumferentially arrayed pairs of flexible grasping portions, such accommodating a cylindrical array of five cartridges, additional variants of the present invention envision redesigning the clip holder with larger numbers of pairs of grasping portions (and associated end supporting tabs) so as to support any number of cartridges, including larger numbers of six or seven cartridges. The configuration of the pairs of opposing grasping portions is further such that they can deflected to desired degrees in order to grasp cartridges of varying dimensions so that a single band can be used with a number of different caliber revolvers.

A plurality of end support tabs are illustrated at 24, 26, 28, 30 and 32, respectively associated with each of the pairs of individual grasping portions 14, 16, 18, 20 and 22. The tabs 24-32 (five shown) each include an interconnecting portion, see at 34, 36, 38, 40 and 42, each of these including an angled bend and which integrally extends from rear annular edge locations of the main band 12 so as to individually orient the end support tabs 24-32 (defined as spaced outwardly beyond a bottom annular edge of the main band 12 so that the face of the tab is generally parallel with the annular edge band) behind its rear annular edge and in spatially supported fashion between the respective pairs of grasping portions 14-22. In this fashion, the end support tabs prevent cartridge slide-out during each of installation of the cartridges, closing of the band, and subsequent manipulation during loading of the cartridges into the individual barrel cylinders.

The band further includes end clasp portions which are depicted by a triangular shaped clasp (configured as a pointed tip 43 from which rearwardly diverges an angled or ramped surface 44 and stepped back surface 45) which is integrated into a first end of the band, this opposed by a substantially second triangular shaped recess configured into a second end and including a ramped interior surface 46 with triangular arrayed rearward facing surface 48 and bottom facing surface 50. As shown, the recessed clasp portion is integrated into the associated end of the band 12 via a further three sided, pseudo triangular recess (see at 47) which interfaces and dimensions a selected one of the pair of grasping portions 22.

A tab 52 extends integrally from selected receiving or recess configured clasp (the rearward facing surface 48 defining an interface with the tab 52. The tab terminates in an angled end most portion 54 which, as shown, includes a curved tip amenable for being grasping by a user.

A barb latch 55 is also depicted which extends at an angle from a common trunk location 57 which also supports the tab 52 and angularly configured/end interconnected end portion 54. The barb latch 55 as a given overall length dimension extending at an oblique angle (see axis 59) outwardly from a circumference defined by the main band 12 (particularly in a closed position as shown in FIGS. 11 and 12.

Figure 4:
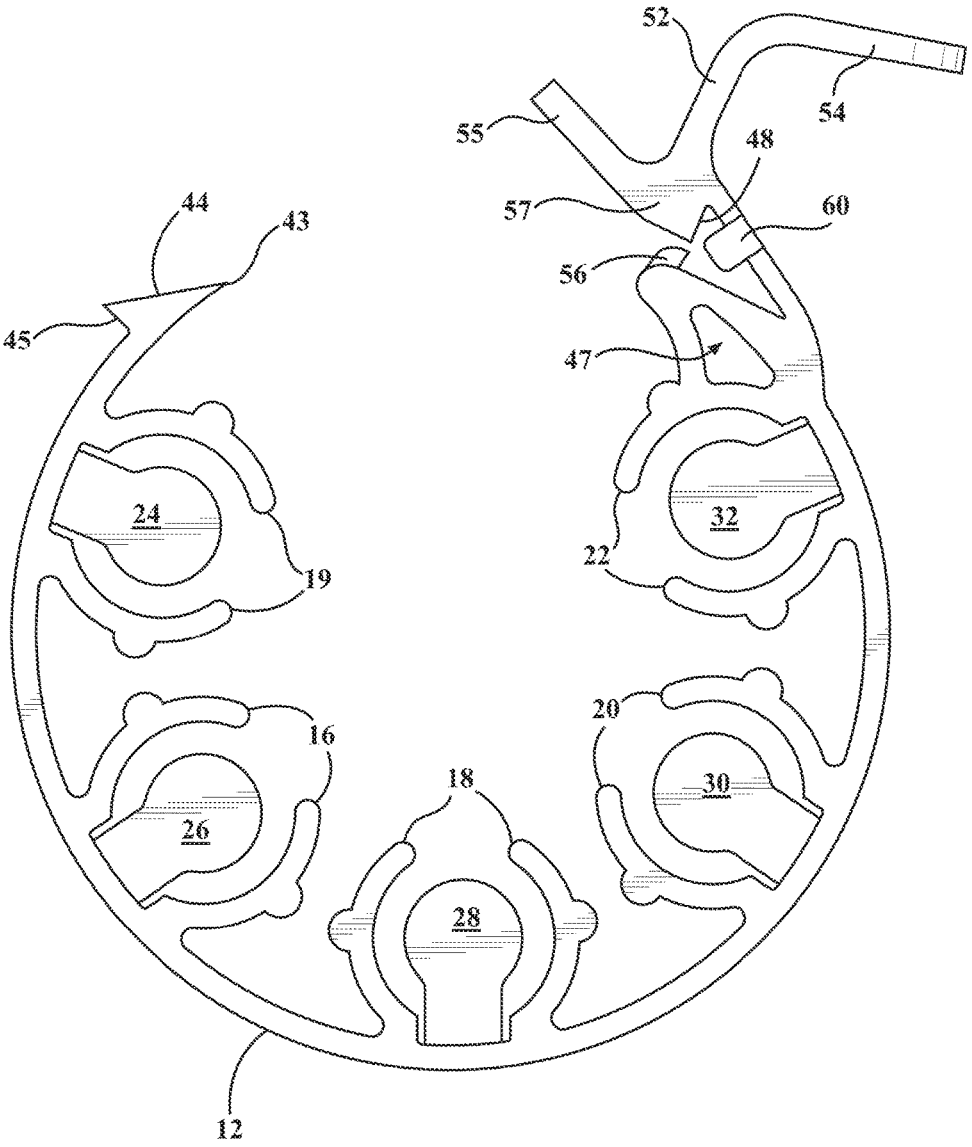
FIG. 4 is a top plan view of cartridge loading clip as substantially depicted in FIG. 3.

As further shown, a gap or spacing 61 (see as best shown in FIG. 4) exists between the connecting trunk 57 and an opposing support portion 63 configured into the main band 12 and in turn integrating the pseudo triangular aperture 47. The dimensioning of this gap 61 defines the lead-in profile for receiving the pointed tip 43 of the triangular inserting portion, with the end clasp defining trunk portion deflecting outwardly sufficiently to permit the triangular inserting clasp portion to be inserted between the locating tabs 64 and 66, following which the trunk 57, with supporting tab 52 and barb latch 55, pivot back (by virtue of their flexible material properties) to secure the triangular portion as best shown in FIGS. 11 and 12.

In operation, a recoil aspect associated with opening the band (from the cartridge carrying position of FIG. 12) resulting in the barb latch exhibiting the tendency to snap back and strike the user's thumb. By virtue of the redesign of the barb latch 55, the variation in its contouring and angling functions to prevent or, at the least attenuate, snapping forces associated with the opening of the clip body. Also shown are lateral abutment portions 56 and 58 associated with the rear annular surfaces of the band 12, these located proximate the clasp portions to assist locating and inter-engaging the clasp portions in a closed position.

Figure 2:
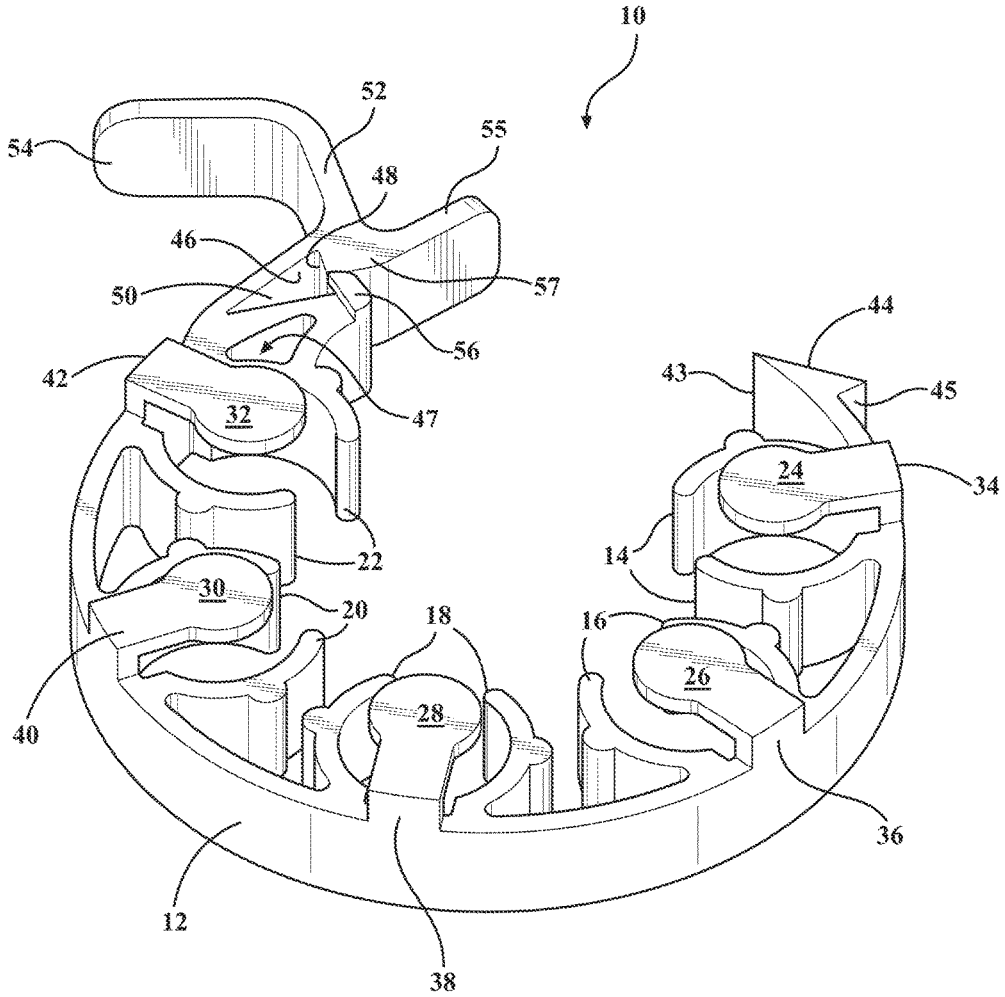
FIG. 2 is a further perspective rotated view of the clip in FIG. 1 from a side angle.
Figure 3:
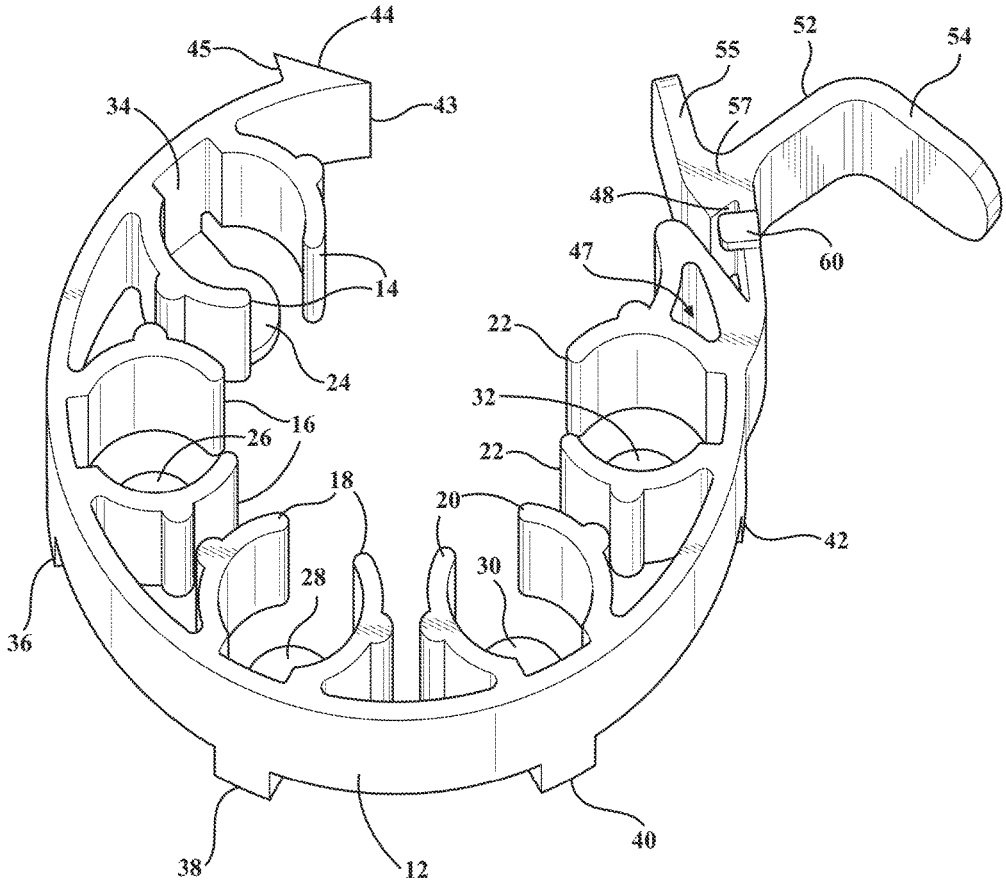
FIG. 3 is a 180° rotated view of the clip from FIGS. 1-2 and depicting an upper supporting side with the inwardly turned end tabs at the lower most position for supporting the center or rim firing support surfaces of the individual cartridges.
Figure 5:
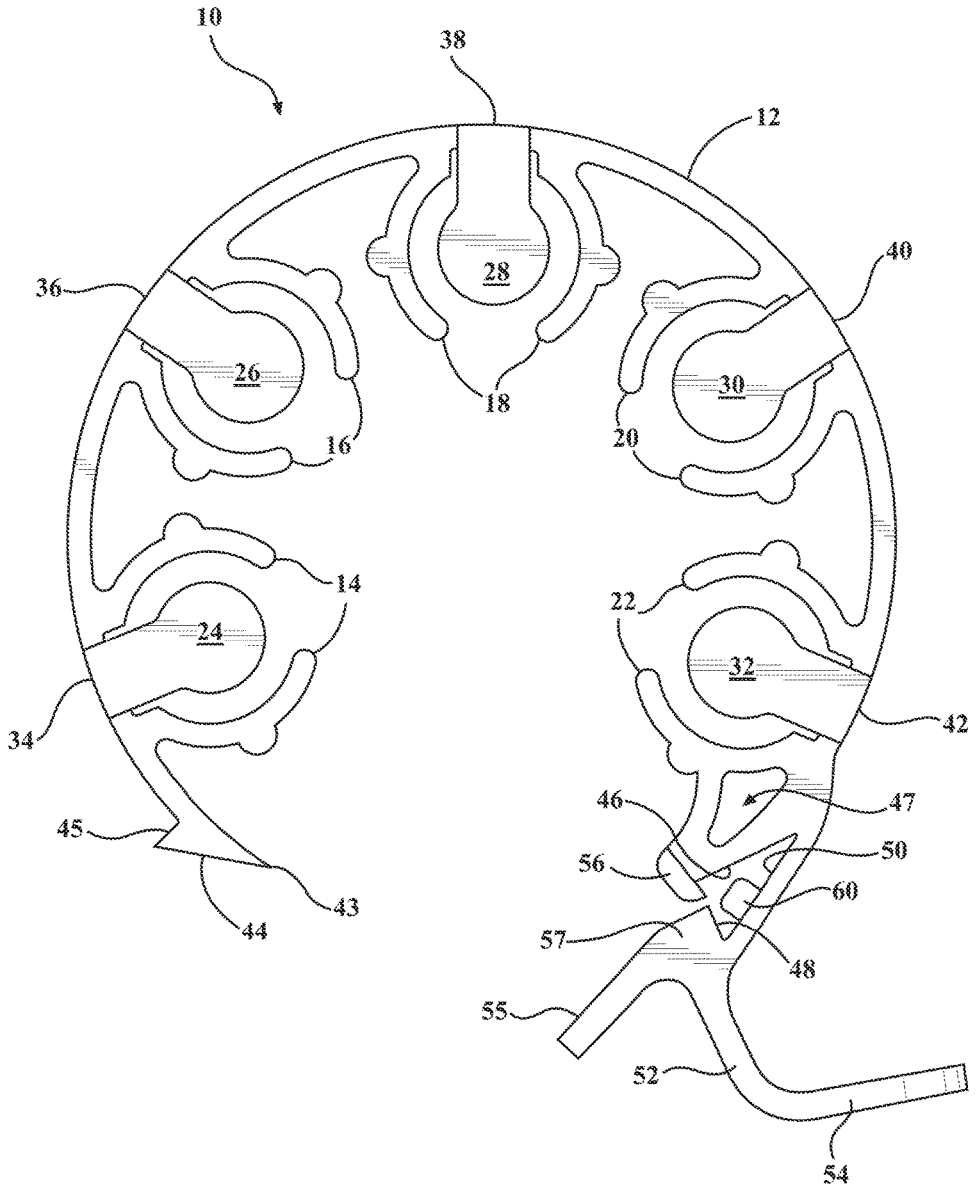
FIG. 5 is a rotated bottom plan view of the cartridge loading clip.
Figure 6:
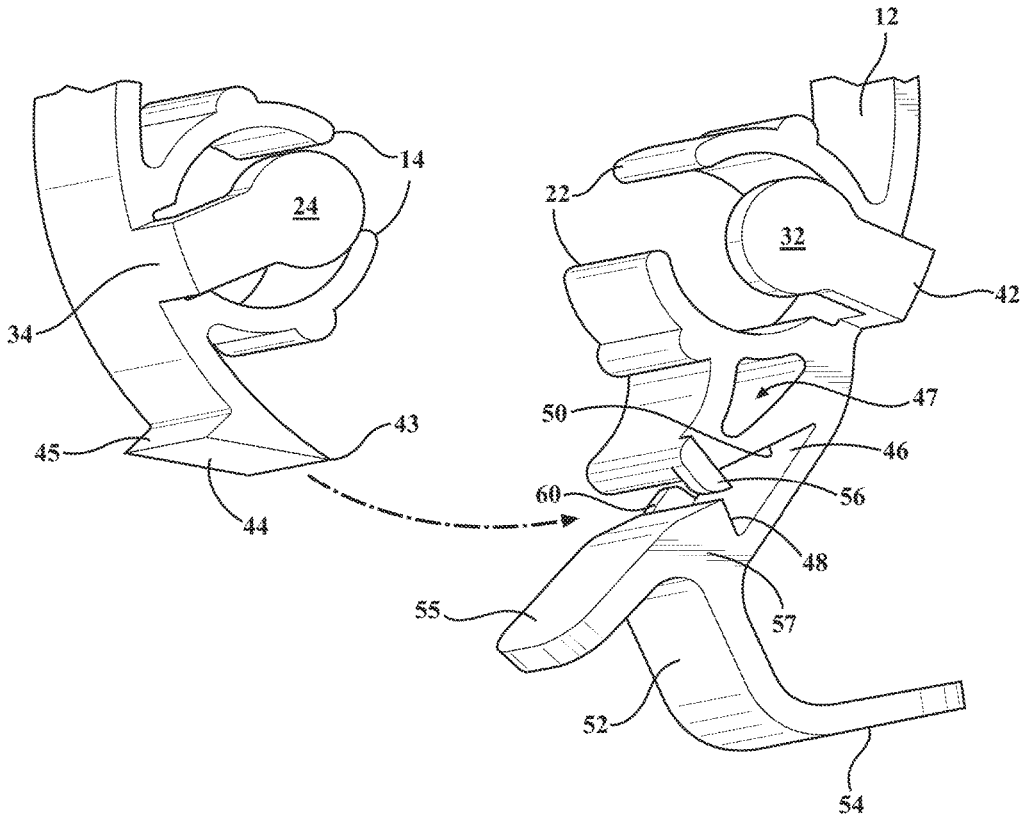
FIG. 6 is an enlarged partial view of opposing clasp portions associated with first and second ends of the generally circumferential arrayed clip.
Figure 7:
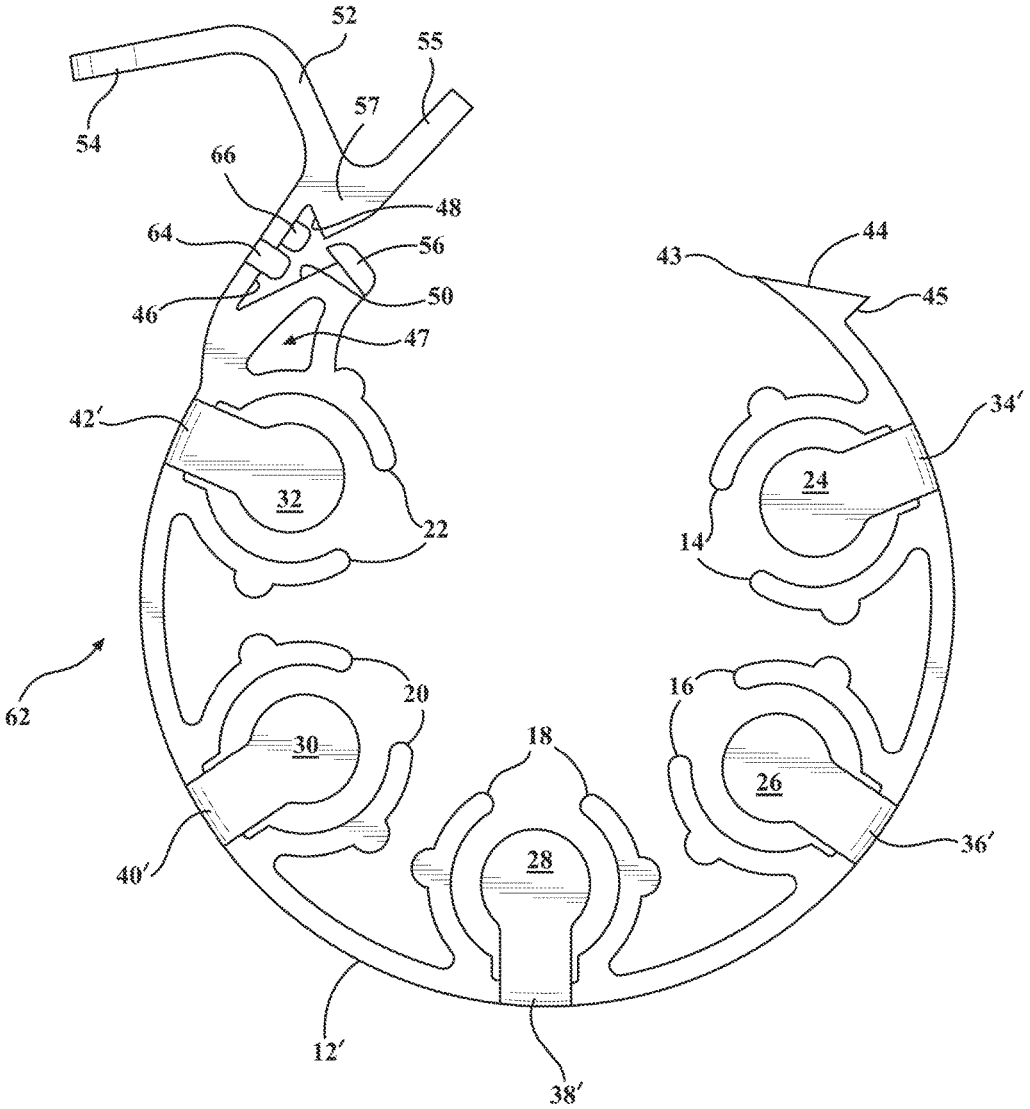
FIG. 7 is a bottom plan view of a cartridge loading clip according to a slightly modified second variant and including locating tabs associated with the receiving clasping portion, such facilitating the opposing inserting clasping portion to be guided and centered for installation reconfigured end tab connecting portions.
Figure 8:
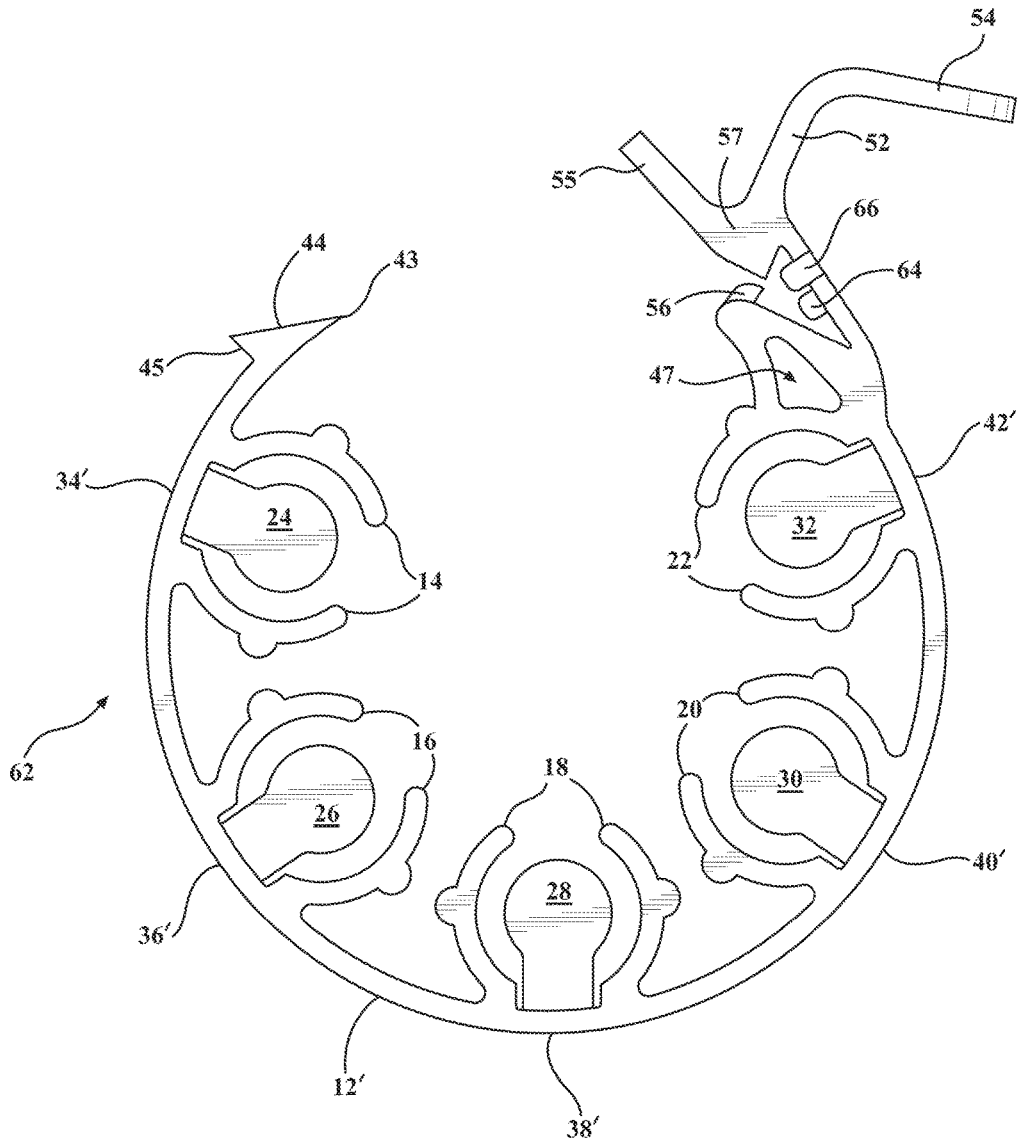
FIG. 8 is a 180° rotated view of the clip in FIG. 7 and depicting an upper supporting side with the inwardly turned end taps at the bottom for supporting the end (center or rim) fire abutment surface of the individually installed cartridges.
Figure 9:
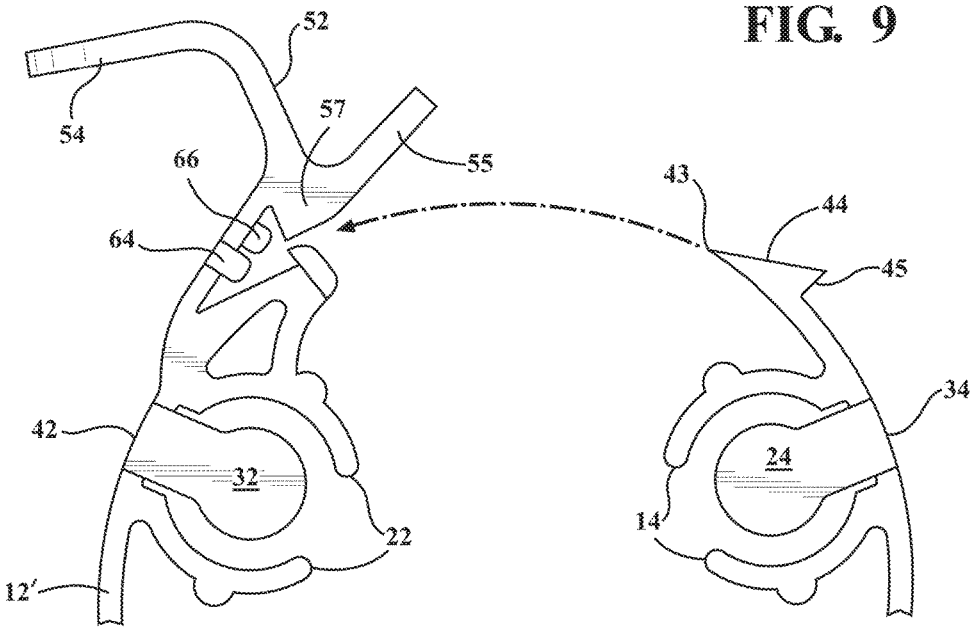
FIG. 9 is an enlarged partial view of opposing clasp portions associated with first and second ends of the generally circumferential arrayed clip of FIG. 7.
Figure 10:
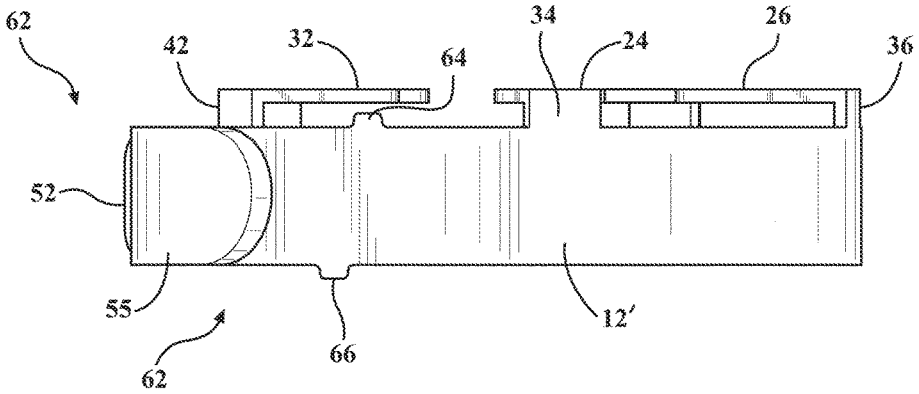
FIG. 10 is a side view of the clip according to the variant of FIG. 7 and depicting the reconfiguration of the band width (wider than FIG. 1), in combination with the revised latch configuration and opposite side located centering tabs.

As previously described, FIG. 2 is a further rotated view of the clip in FIG. 1 from a side angle, with FIG. 3 presenting an 180° rotated view of the clip from FIGS. 1-2 and depicting an upper supporting side with the inwardly turned end tabs at the lower most position for supporting the center or rim firing support surfaces of the individual cartridges. FIG. 4 is a top plan view of cartridge loading clip as substantially depicted in FIG. 3. Of note, a further abutment portion 60 is depicted on the reverse (top) side of the band 12 (hidden in FIG. 1) proximate the recessed profile of the second clasp portion prior to the end tab 53. FIG. 5 is a rotated bottom plan view of the cartridge loading clip, with FIG. 6 further illustrating an enlarged partial view of opposing clasp portions associated with first and second ends of the generally circumferential arrayed clip.

FIGS. 7-12 present a series of plan, profile and partial views of a related version of clip, generally at 62, according to a further preferred variant of the clip 10 as depicted in FIGS. 1-6. For purposes of the updated embodiment, reference will be limited to those features which differ from the first variant 10 of FIGS. 1-6. These include any desired reconfiguration of the band 12 width or thickness, such as which is somewhat widened as best shown at 12' in FIG. 10 in comparison to at 12 in FIGS. 1-2.

The latch configuration of the updated embodiment further includes a reconfigured pair of locating tabs 64/66 associated with the receiving clasping portion, such facilitating the opposing inserting clasping portion to be guided and centered for installation in the manner previously described. Additional features include the provision of an arcuate edge profile associated with each of reconfigured and end tab supporting interconnecting portions, see at 34', 36', 38', 40' and 42', as compared to those depicted at 36-42 in FIGS. 1-6 with sharp angled edge breaks between the integrally extending base locations associated with the outer band surface and the angle and inwardly extending portions leading to the tabs 24-32.

In this fashion, and referring again finally to FIG. 12, the pairs of arcuate grasping portions support each of the cartridges 2-6 in successively loaded fashion so that the center or firm fire end surface of each cartridge is supported in abutting fashion against the bottom spaced inside facing surface of each tab support. The one piece band is then closed by seating the triangular shaped clasp configured at the first end of the body, again with pointed tip 43 and angled or ramped surface 44 and stepped back surface 45, this engaged by the opposed triangular shaped recess configured into a second end and again including a ramped interior surface 46 with triangular arrayed rearward facing surface 48 and bottom facing surface 50.

With the assistance of the tabs 64/66, the clasp is retained in centered and engaged fashion within the seating recess and, upon positioning the loaded clip in alignment with the open rear of the cylindrical barrel drum so that the tips and substantial length of the cartridges projecting from the edge of the main band are substantially seated within aligning barrel locations. The tab 54 is then deflected to cause the clasp to become unseated from the receiving triangular profile (surfaces 46, 48 and 50) thereby opening the band so that a lateral pulling motion exerted on the tab results in the cartridges being successively disengaged from the pairs of grasping portions concurrent with the body being pulled away, with the cartridges dropping fully into the individual barrel receiving locations in rapid succession.

Having described my invention, other and additional preferred embodiments will become apparent to those skilled in the art to which it pertains, and without deviating from the scope of the appended claims.

We claim:

1. A speed loader clip for supporting a plurality of cartridges in a cylindrical array prior to the cartridges being loaded into a plurality of individual chambers configured within an open rotated cylinder barrel of a revolver style firearm, said clip comprising:

a body having an arcuate extending band of material with first and second opposing ends;

individual pairs of inward and arcuate projecting grasping portions at circumferential locations along said arcuate band, said pairs of grasping portions each adapted for supporting one of the cartridges;

support tabs extending from said band, each terminating at a location between a selected one of said pair of projecting portions for preventing slide-out of the cartridge both prior and during loading into the cylinder barrel;

end clasp portions integrated into said opposing ends of said band to permit said clip to be carried in a closed position with the supported cartridges;

lateral abutment portions located proximate the clasp portions to assist locating and inter-engaging said clasp portions in the closed position, said abutment portions projecting from each of opposite sides of said arcuate band to prevent lateral relative displacement of said end clasp portions in the closed position; and upon adapting to pre-insert portions of each cartridge projecting from said band into the open cylinder barrel, a tab located in proximity to a selected one of said inter-engaged end clasp portions being manipulated to open said band and, upon laterally pulling the band away from the barrel, causing the cartridges to separate from said pairs of grasping portions and to drop into the individual cylinder chambers.

2. The invention of claim 1, one of said end clasp portions further comprising a triangular shape with a pointed tip from which rearwardly diverges an angled or ramped surface and stepped back surface.

3. The invention as described in claim 2, the other of said end clasp portions further comprising a triangular shaped configured recess including a ramped interior surface with triangular arrayed rearward facing surface and bottom facing surface.

4. The invention as described in claim 3, further comprising a gripping tab extending from said band in proximity to said triangular recess.

5. The invention as described in claim 4, said gripping tab further comprising a curved tip amenable for grasping by a user.

6. The invention as described in claim 4, further comprising a barb latch extending at an angle from a common trunk location of said band which also supports said tab.

7. The invention as described in claim 6, further comprising said barb latch extending at an oblique angle outwardly from a circumference defined by the band of material.

8. The invention as described in claim 1, said body further comprising a plasticized material.

9. A speed loader clip for supporting a plurality of cartridges in a cylindrical array prior to the cartridges being loaded into a plurality of individual chambers configured within an open rotated cylinder barrel of a revolver style firearm, said clip comprising:

a body having an arcuate extending band of material with first and second opposing ends;

individual pairs of inward and arcuate projecting grasping portions at circumferential locations along said arcuate band, said pairs of grasping portions each adapted for supporting one of the cartridges;

support tabs extending from said band, each terminating at a location between a selected one of said pair of projecting portions for preventing slide-out of the cartridge both prior and during loading into the cylinder barrel;

end clasp portions integrated into said opposing ends of said band to permit said clip to be carried in a closed position with the supported cartridges;

one of said end clasp portions having a triangular shape with a pointed tip from which rearwardly diverges an angled or ramped surface and stepped back surface, the other of said end clasp portions having a triangular shaped configured recess including a ramped interior surface with triangular arrayed rearward facing surface and bottom facing surface;

lateral abutment portions located proximate the clasp portions to assist locating and inter-engaging said clasp portions in the closed position, said abutment portions projecting from each of opposite sides of said arcuate band in proximity to said triangular shaped recess to prevent lateral relative displacement of said triangular shape end clasp in the closed and engaged position and upon adapting to pre-insert portions of each cartridge projecting from said band into the open cylinder barrel, a tab located in proximity to a selected one of said inter-engaged end clasp portions being manipulated to open said band and, upon laterally pulling the band away from the barrel, causing the cartridges to separate from said pairs of grasping portions and to drop into the individual cylinder chambers.

10. The invention as described in claim 9, further comprising a gripping tab extending from said band in proximity to said triangular recess.

11. The invention as described in claim 10, said gripping tab further comprising a curved tip amenable for grasping by a user.

12. The invention as described in claim 10, further comprising a barb latch extending at an angle from a common trunk location of said band which also supports said tab.

13. The invention as described in claim 12, further comprising said barb latch extending at an oblique angle outwardly from a circumference defined by the band of material.

14. The invention as described in claim 9, said body further comprising a plasticized material.

* * * * *